US009157245B2

(12) United States Patent
Thacker

(10) Patent No.: US 9,157,245 B2
(45) Date of Patent: Oct. 13, 2015

(54) SCAFFOLD MOUNT BRACKET

(71) Applicant: Saferite Platforms, Inc.

(72) Inventor: Steve Howard Thacker, Humble, TX (US)

( * ) Notice: Subject to any disclaimer, the term of this patent is extended or adjusted under 35 U.S.C. 154(b) by 0 days.

(21) Appl. No.: 14/120,921

(22) Filed: Jul. 9, 2014

(65) Prior Publication Data

US 2015/0023726 A1 Jan. 22, 2015

Related U.S. Application Data

(60) Provisional application No. 61/856,174, filed on Jul. 19, 2013.

(51) Int. Cl.
*E04G 7/02* (2006.01)
*E04G 7/30* (2006.01)
*E04G 7/32* (2006.01)

(52) U.S. Cl.
CPC *E04G 7/307* (2013.01); *E04G 7/02* (2013.01); *E04G 7/32* (2013.01)

(58) Field of Classification Search
CPC ..... E04G 7/02
USPC ..... 403/49, 319, 355, 161; 182/186.7, 182/186.8
See application file for complete search history.

(56) References Cited

U.S. PATENT DOCUMENTS

| | | | | |
|---|---|---|---|---|
| 4,180,342 | A * | 12/1979 | Layher | 403/24 |
| 7,779,599 | B2 * | 8/2010 | Jolicoeur et al. | 52/650.3 |
| 2004/0016598 | A1 * | 1/2004 | Verdijk | 182/100 |
| 2011/0180350 | A1 * | 7/2011 | Thacker | 182/186.8 |
| 2011/0209947 | A1 * | 9/2011 | Allred et al. | 182/194 |
| 2011/0262215 | A1 * | 10/2011 | Thacker | 403/81 |

* cited by examiner

*Primary Examiner* — Daniel Wiley

(57) ABSTRACT

A scaffold mount bracket having an upper horizontal mount member, a wedge head, a lower horizontal mount member, a clamp, a vertical mount member, the vertical mount member having coupled proximate to the upper end thereof, and orthogonally thereto, the upper horizontal mount member and coupled to a lower end of the vertical mount member, and orthogonally thereto, the lower horizontal mount member. Coupled to the top of the vertical mount member is an attachment member having an aperture or structure for receiving, either directly or indirectly, a cable for hoisting or lowering a scaffold to which the invention is mounted or for hoisting or lowering a separate scaffold member or structure.

12 Claims, 8 Drawing Sheets

SCAFFOLD MOUNT BRACKET

CROSS REFERENCE TO RELATED APPLICATION

This application claims priority to U.S. Provisional Application No. 61/856,174 filed on Jul. 19, 2013, entitled "SCAFFOLD MOUNT BRACKET".

FIELD OF THE INVENTION

This invention relates to scaffolds. Scaffolds are used, inter alia, in the industrial, commercial, petro-chemical, power source, general industry and residential construction markets.

BACKGROUND

Tube and coupler scaffolds are so-named because they are built from tubing connected by coupling devices. Due to their strength, they are frequently used where heavy loads need to be carried, or where multiple platforms must reach several stories high. Components of scaffolds include vertical standards having coupling rings or rosettes, horizontal components such as ledgers and guardrails coupled to the coupling rings or rosettes, footings, decks/platforms and diagonal braces. Their versatility, which enables them to be assembled in multiple directions in a variety of settings, also makes them difficult to build correctly.

Conventional scaffolding systems have various components. FIG. 1 illustrates a supported scaffold 100 consisting of one or more platforms supported by rigid support members such as poles, tubes, beams, brackets, posts, frames and the like. More specifically, the supported scaffold 100 includes the following components: deck/platform 101, horizontal members, or ledgers 102, vertical standards 103. Additional components include diagonal braces to increase the stiffness and rigidity of the scaffold 100.

FIG. 2 is an illustration of a vertical standard 103. Vertical standards are typically cylindrical tubes 200 comprised of hot-dip galvanized steel or aluminum. A collar with an expanded or reduced diameter or a spigot at either or both ends of the vertical standard facilitates the joining of vertical standards from end to end. Rosettes 201 are positioned and then welded or otherwise attached along the tubes providing connections for horizontal members and diagonal braces. The vertical standard can have from one to 8 or more rosettes placed along the tubing using a predetermined spacing between rosettes, for example, about every 20 inches.

FIG. 3 illustrates a ledger 102. A ledger is a horizontal member that serves as both a guardrail and bracing element. The ledger 102 is comprised of tubing 300, heads 301 and wedges 302. Ledgers 102 are available in different lengths, depending on the scaffolding bay length, deck type and load. Once the tubing is installed, decks or platforms 101 made of, e.g., hot-dip galvanized steel, aluminum, wood or an aluminum frame with plywood board are installed to allow workers to traverse the scaffold 100 and install the guardrails (e.g., ledgers 102).

Referring now to FIG. 4, wedge 302 is shown being hammered into the slot or gap of head 301 at the end of a ledger 102 so as to couple it to the rosette 201 of the vertical standard 200.

A conventional rosette 500, as seen in FIG. 5, has a central aperture 503 to receive the vertical tubing, four small openings 501A-D to facilitate right-angled connections and four larger openings 502 A-D to facilitate connections at any angles. Typically, a vertically and horizontally slotted head 504 coupled to the end of a ledger is positioned with respect to the rosette 500 such that the horizontal slot of the head 504 is positioned over and under the rosette 500 and the vertical slot of the head is aligned with an aperture of the rosette 500. A wedge 302 is then hammered into the vertical slot (or gap) to couple the ledger 102 via the head 504 to the vertical standard 103 via the rosette 500 using, inter alia, frictional force.

What is desired is a structure that can be coupled to vertical standards of a conventional scaffold structure so as to allow the scaffold structure to be raised and lowered using a machine comprised of one or a plurality of cables, pulleys, motors or similar electromechanical devices.

SUMMARY

The invention comprises a scaffold mount bracket configured to be coupled to a rosette and vertical member of a conventional scaffold. The ring, collar, rosette or component with similar functionality, is referred to herein as a rosette with respect to the invention; the vertical standard or component with similar functionality, is referred to herein as a vertical member with respect to the invention and the ledger, guardrail or component with similar functionality is referred to herein as a horizontal member. The use of the foregoing terms is not to be interpreted as limiting the scope of the invention.

As noted herein, components of the invention include an upper horizontal mount member, having coupled to a first end thereof, a wedge head; a lower horizontal mount member, having coupled at a first end thereof, a clamp mechanism; a vertical mount member, the vertical mount member having coupled proximate to the upper end thereof, and orthogonally thereto, a second end of the upper horizontal mount member; and coupled to a lower end of the vertical mount member, and orthogonally thereto, a second end of the lower horizontal mount member. The upper horizontal mount member and lower horizontal mount member are substantially parallel with respect to each other and lie substantially in the same plane. Coupled to the top of the vertical mount member is an attachment member having a structure for receiving, either directly or indirectly, a cable for hoisting or lowering a scaffold to which the invention is mounted, or for hoisting or lowering a separate scaffold member or structure. A reinforcing plate is positioned in the plane of, and coupled to each of, the upper horizontal mount member, vertical mount member and lower horizontal mount member so as to strengthen the attachment of the upper horizontal mount member to the vertical mount member and the lower horizontal mount member to the vertical mount member.

In operation, the wedge head is coupled to a rosette on a vertical scaffold member and then the clamp mechanism is coupled to said vertical scaffold member. A cable, either directly, or via a separate device such as a coupling component such as a carabineer, bolt and nut, revolute, pin, rivet and associated washers, bushings and/or bearings and the like is inserted, is coupled to the attachment member, such as through an aperture therein, so as to be driven, wound, unwound, retracted or released so as to either raise or lower the scaffold to which the invention is coupled. The rosette includes a traditional rosette having apertures for receiving mating elements, or prongs, of a wedge head. The wedge head can be a conventional wedge head or can have an internal wedge assembly within the upper horizontal mount member, the internal wedge assembly having a rod with a wedge portion at a first end thereof, the rod being coupled at a second end thereof to an internal crank/cam assembly, an external handle coupled to a crank axle of the internal crank/cam assembly, the wedge head having at least one or a plurality of mating elements or prongs dimensioned to fit within a grid of apertures formed in the rosette, the wedge head having a bore through which the wedge portion wholly or partially extends to lock the wedge head, and hence, the upper horizontal mount member to the rosette and wholly or partially retract to unlock the wedge head, and hence, the upper horizontal mount member from the rosette.

The invention enables erectors to build large area heavy duty system scaffold platforms from a safe elevation then either raise or lower system scaffold platform to the desired work location, thus greatly reducing the erector's exposure to falls. The invention will reduce labor cost and man-hours per project thus again reducing length of time an erector is exposed to extreme heights. The invention increases safety and production during major industrial and heavy commercial construction projects.

To those skilled in the art to which this invention relates, many changes in construction and widely differing embodiments and applications of the invention will suggest themselves without departing from the scope of the invention as defined herein and in the appended claims. The disclosures and the descriptions herein are purely illustrative and are not intended to be in any sense limiting.

DESCRIPTION OF THE DRAWINGS

A more complete understanding of the invention may be obtained by reference to the following Detailed Description, when taken in conjunction with the accompanying Drawings, wherein.

DETAILED DESCRIPTION

Figure 1:
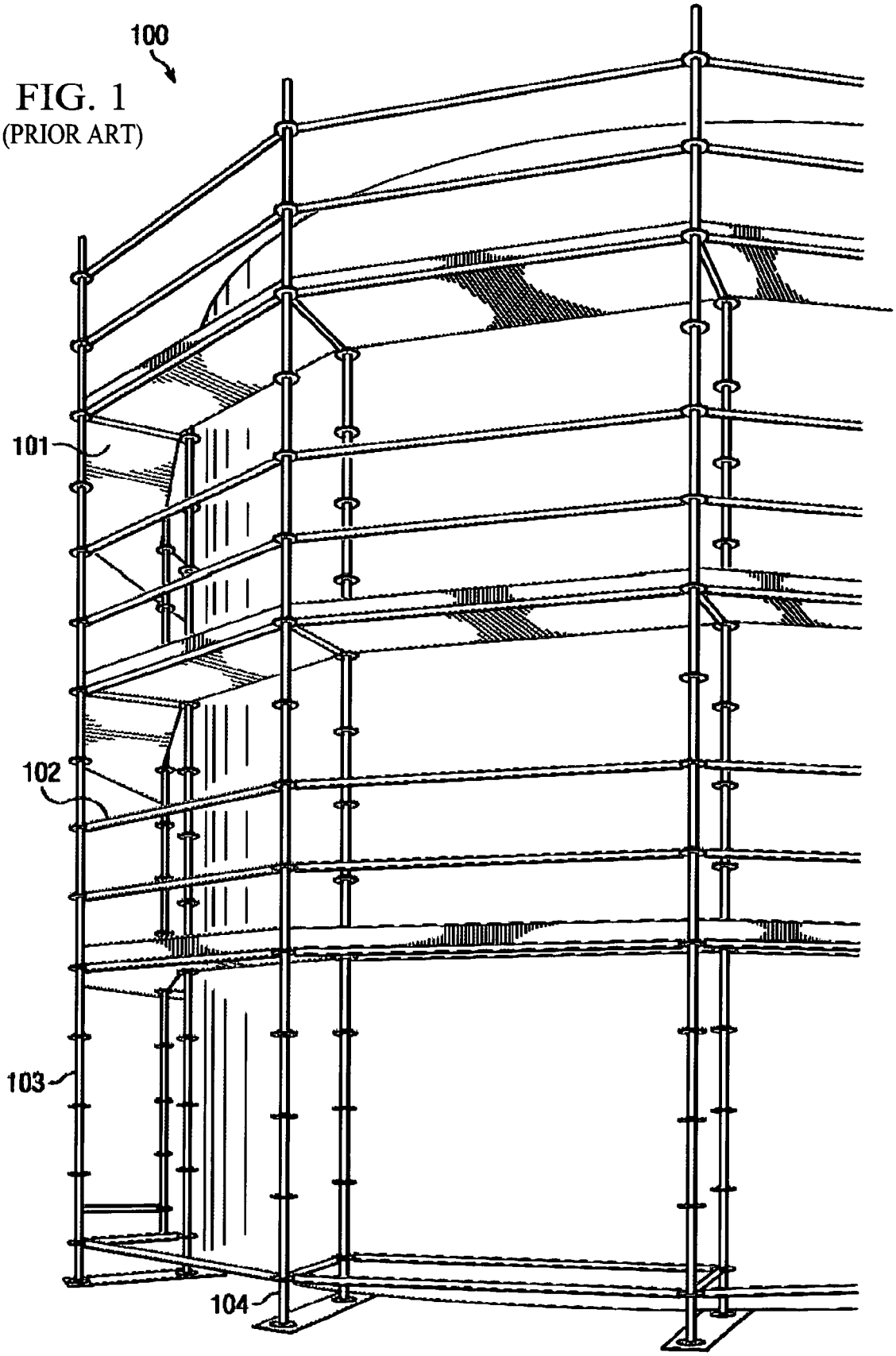
FIG. 1 (PRIOR ART)
FIG. 1 illustrates a scaffold structure.
Figure 2:
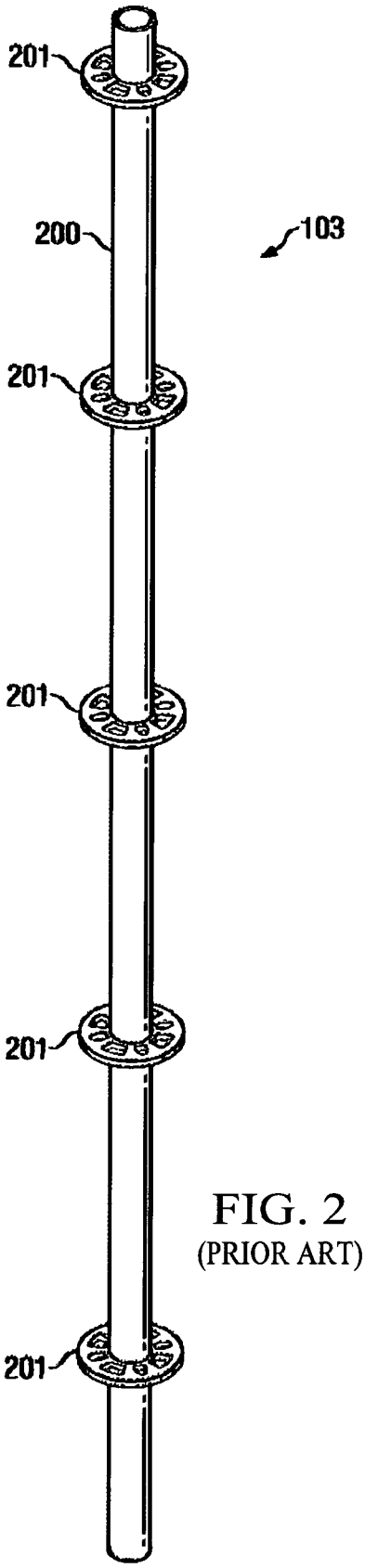
FIG. 2 (PRIOR ART)
FIG. 2 illustrates a vertical standard.
Figure 3:
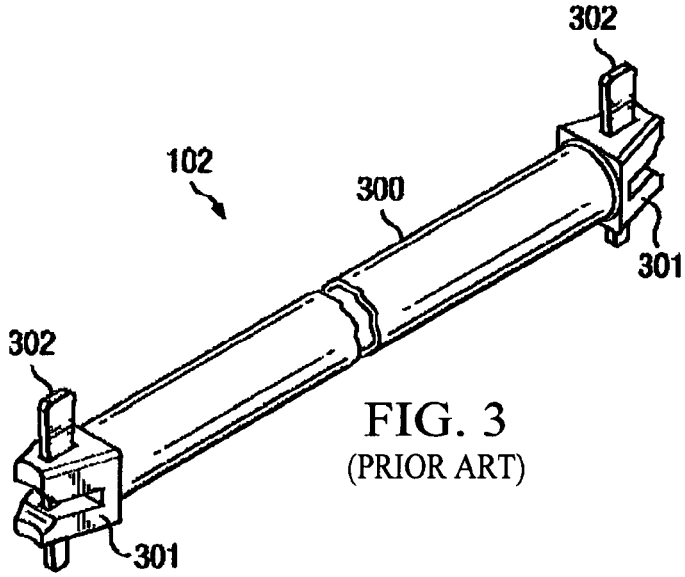
FIG. 3 (PRIOR ART)
FIG. 3 illustrates a conventional ledger.
Figure 4:
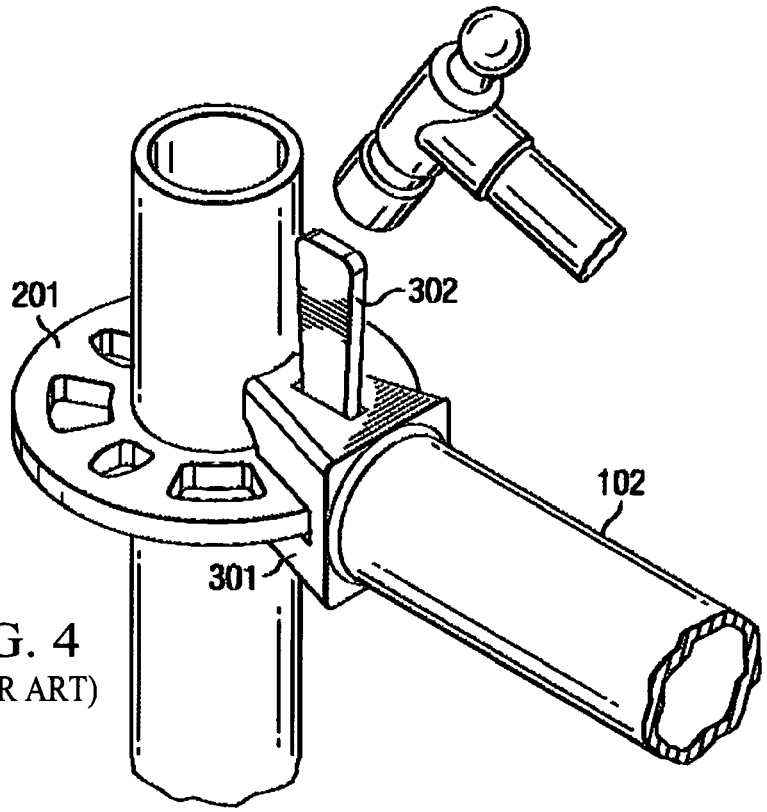
FIG. 4 (PRIOR ART)
FIG. 4 illustrates the installation of an unsecured wedge into a conventional ledger head.
Figure 5A:
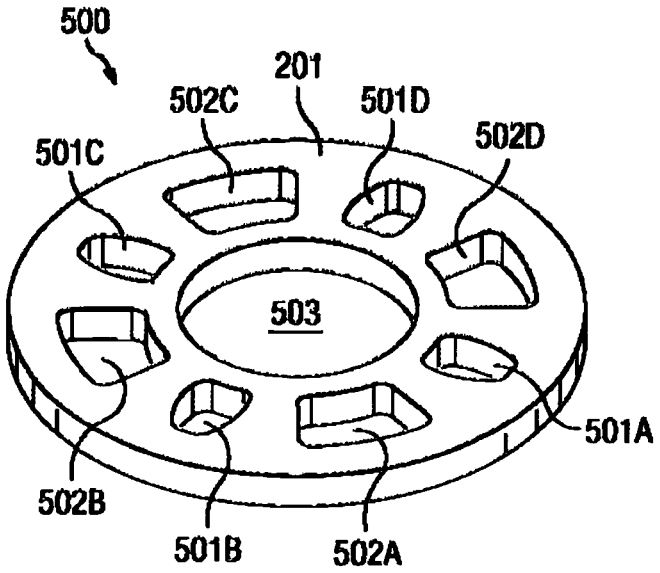
FIG. 5A (PRIOR ART)
FIG. 5A illustrates a rosette.
Figure 5B:
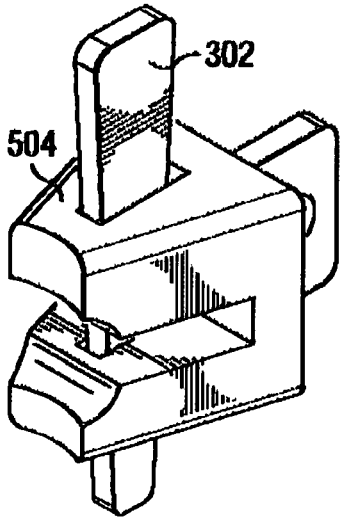
FIG. 5B (PRIOR ART)
FIG. 5B illustrates a conventional head and wedge.
Figure 6:
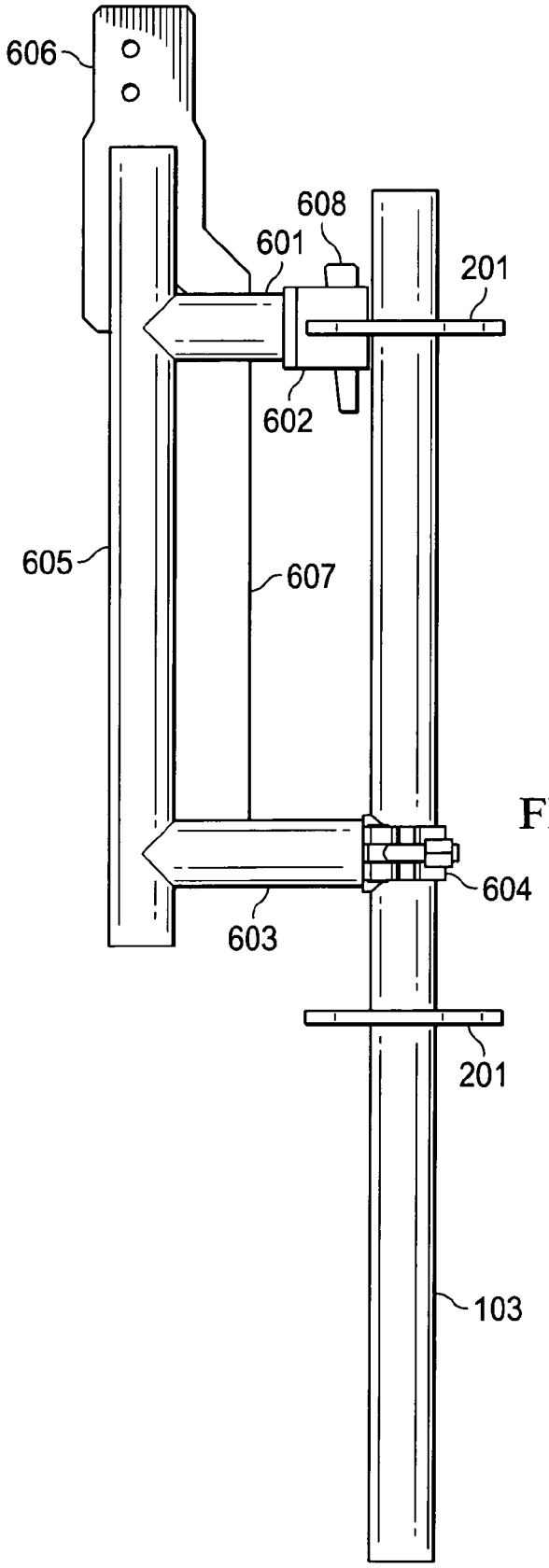
FIG. 6 is a front view of the invention.
Figure 7:
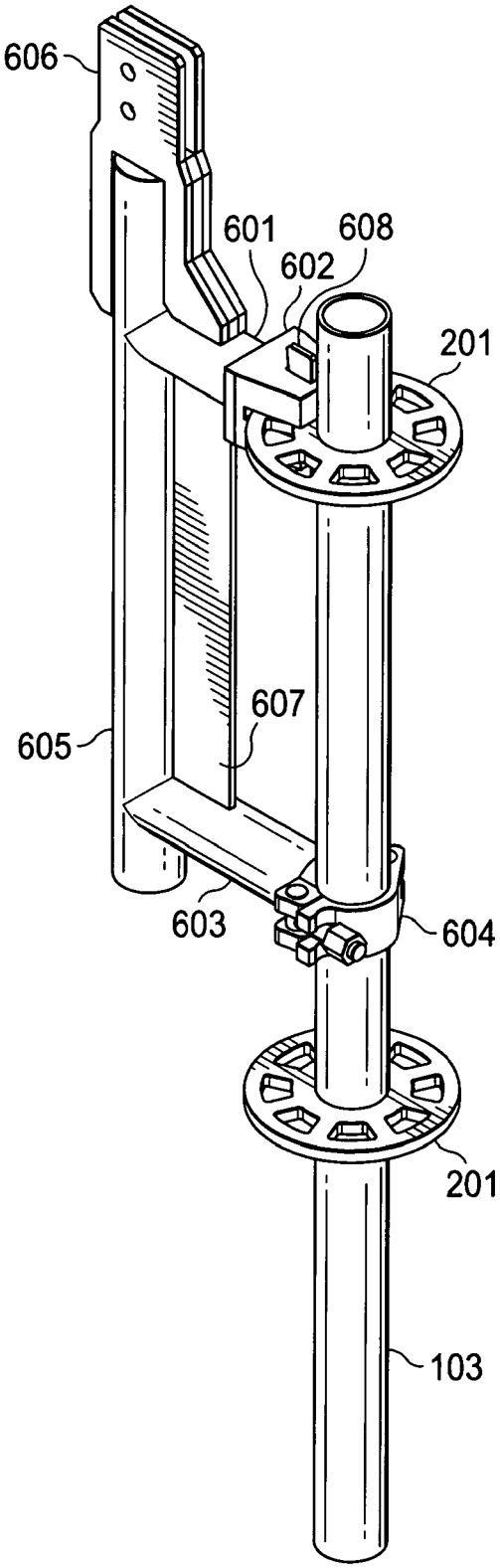
FIGS. 7-10 are isometric views of the invention.
Figure 8:
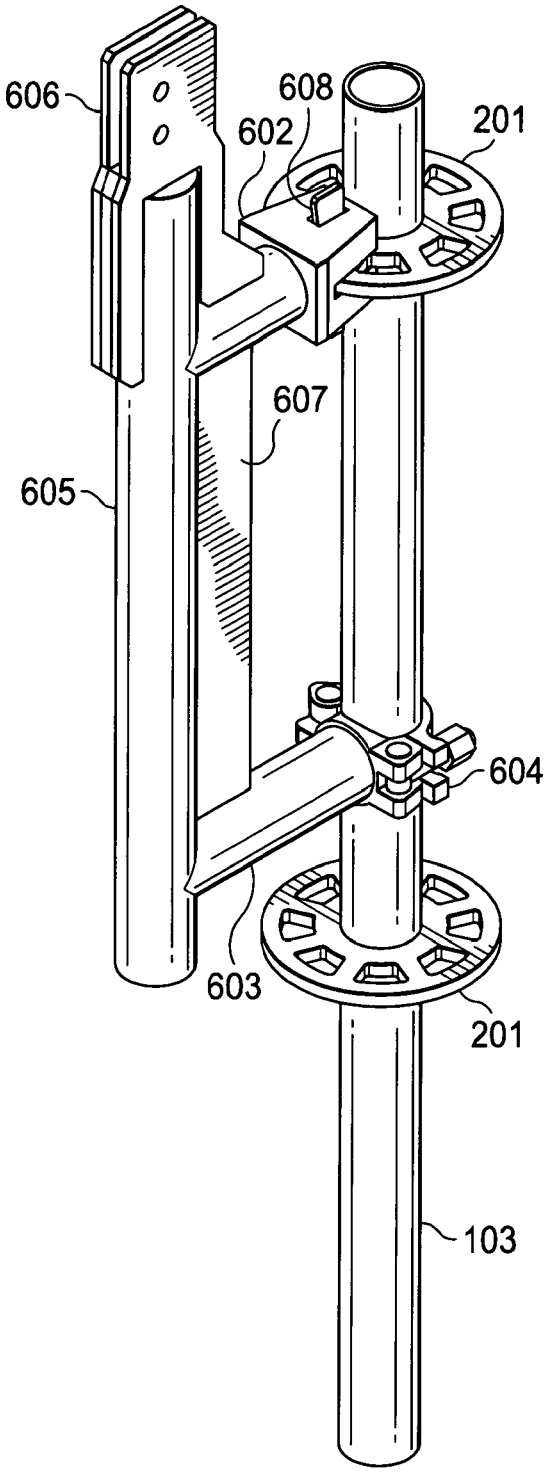
Figure 9:
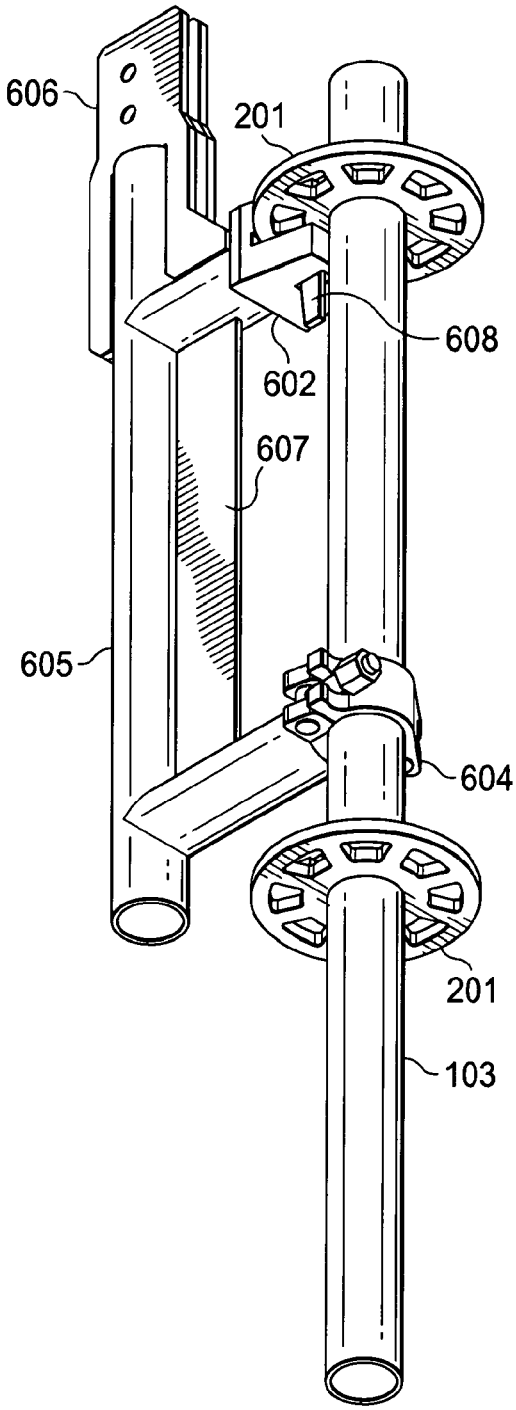
Figure 10:
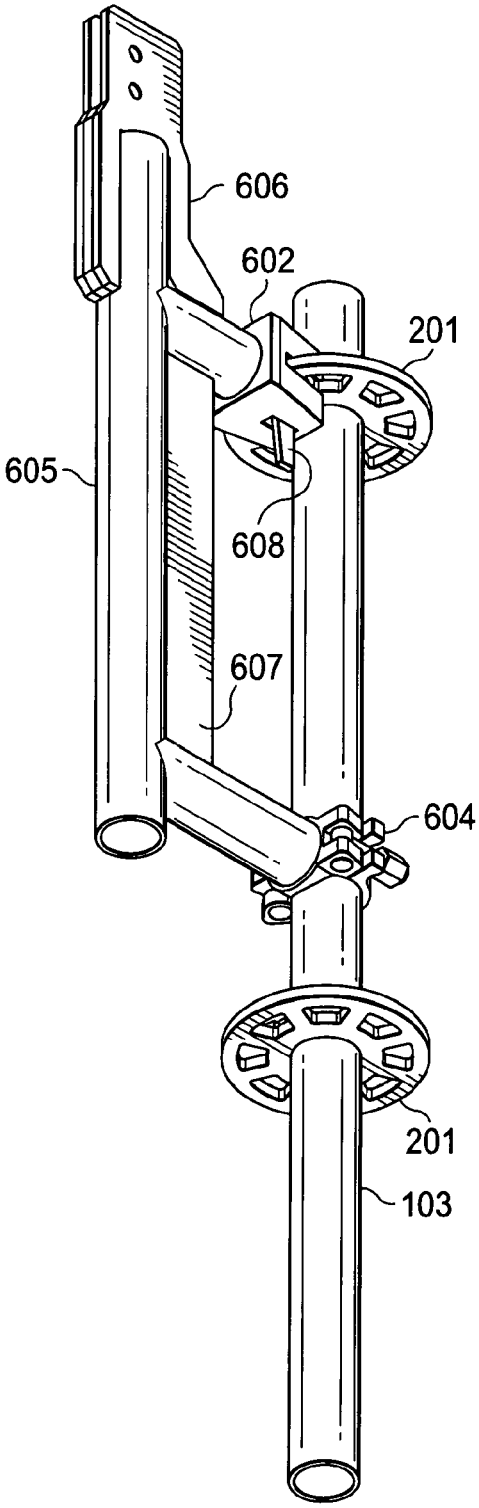
Figure 11:
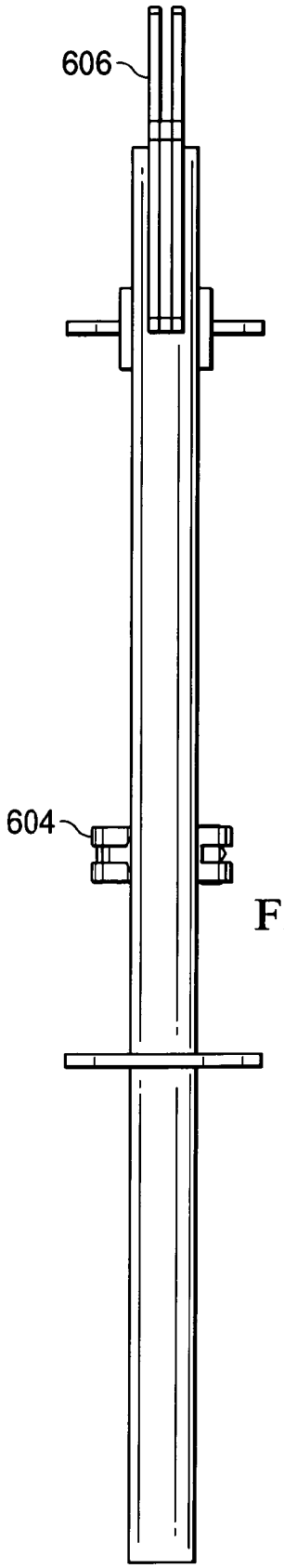
FIG. 11 is a left view of the invention.
Figure 12:
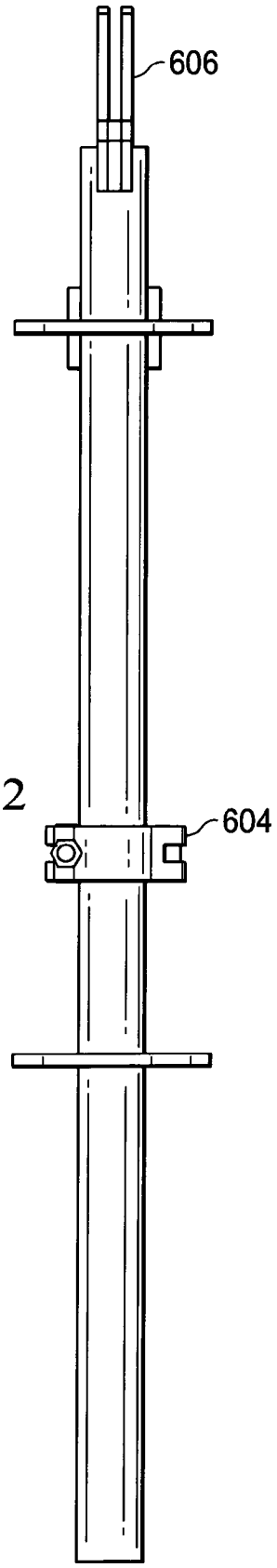
FIG. 12 is a right view of the invention.
Figure 13:
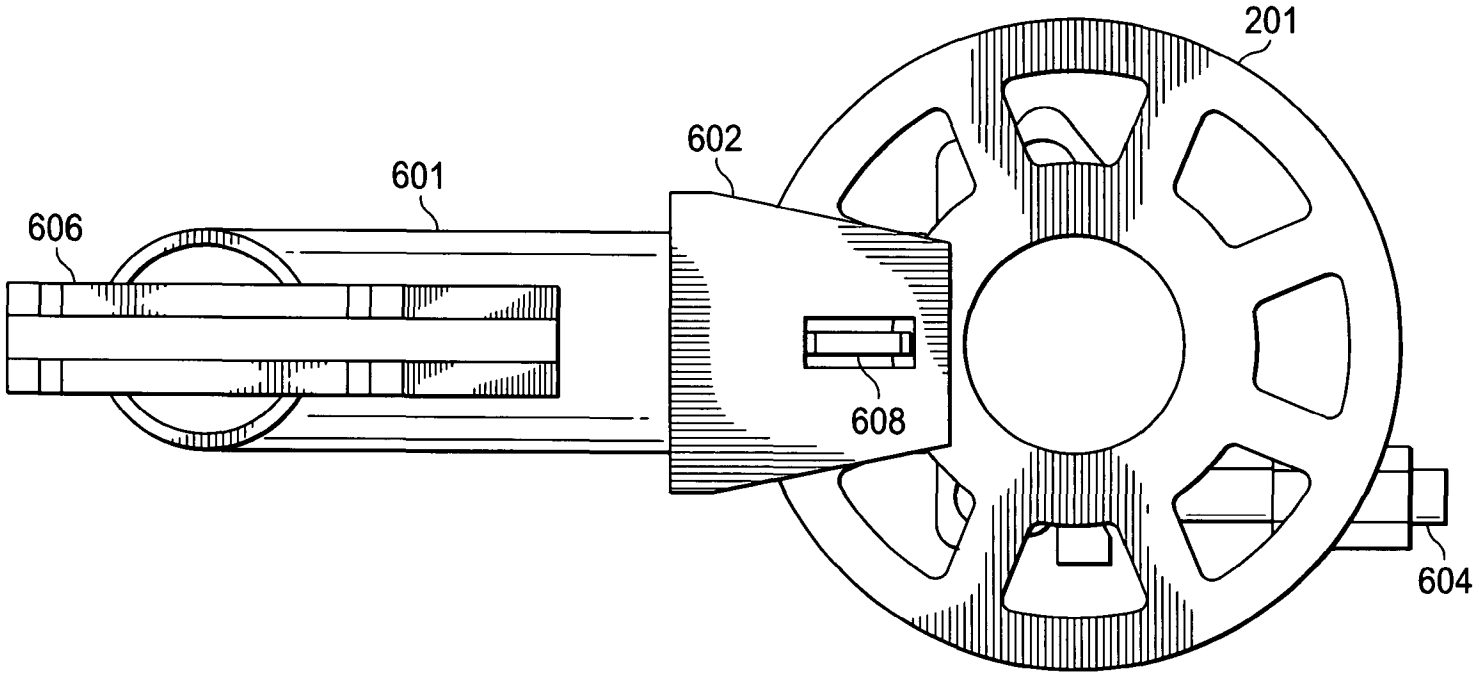
FIG. 13 is a top view of the invention.

Referring now to the various views of FIGS. 6-13, components of the invention 600 includes an upper horizontal mount member 601, having coupled to a first end thereof, a wedge head 602; a lower horizontal mount member 603, having coupled at a first end thereof, a clamp mechanism 604; a vertical mount member 605, the vertical mount member 605 having coupled proximate to the upper end thereof, and orthogonally thereto, a second end of the upper horizontal mount member 601; and coupled to a lower end of the vertical mount member 605, and orthogonally thereto, a second end of the lower horizontal mount member 603.

The upper horizontal mount member 601 and lower horizontal mount member 603 are substantially parallel with respect to each other and lie substantially in the same plane. Coupled to the top of the vertical mount member 605 is an attachment member 606 having a structure for receiving, either directly or indirectly, a cable for hoisting or lowering a scaffold to which the invention is mounted, or for hoisting or lowering a separate scaffold member or structure. The attachment member is comprised of, inter alia, apposite plates having at least one transverse bore therethrough for receiving, either directly or indirectly, a cable for hoisting or lowering a scaffold to which the mount is mounted or for hoisting or lowering a separate scaffold member or structure.

The clamp mechanism 604 comprises any of a half clamp, quick-release clamp, half-coupler clamp, a G clamp or quick trigger clamp.

A reinforcing plate 607 is positioned in the plane of, and coupled to each of, the upper horizontal mount member 601, vertical mount member 605 and lower horizontal mount member 603 so as to strengthen the attachment of the upper horizontal mount member 601 to the vertical mount member 605 and the lower horizontal mount member 603 to the vertical mount member 605.

In operation, the wedge head 602 is coupled to a rosette 201 on a vertical scaffold member 103 and then the clamp mechanism 604 is coupled to said vertical scaffold member 103. A cable, either directly, or via a separate device such as a coupling component such as a carabineer, bolt and nut, revolute, pin, rivet and associated washers, bushings and/or bearings and the like is inserted, or coupled to the attachment member 606, such as through an aperture or bore therein or therethrough, the cable to be driven, wound, unwound, retracted or released so as to either raise or lower the scaffold to which the invention is coupled.

The rosette 201 is in coaxial alignment with the vertical scaffold member 103 and includes a traditional rosette having apertures for receiving mating elements, or prongs, of a wedge head 602. The wedge head 602 can be a conventional wedge head being held to the vertical member using a wedge key 608 or can have an internal wedge assembly within the upper horizontal mount member, the internal wedge assembly having a rod with a wedge portion at a first end thereof, the rod being coupled at a second end thereof to an internal crank/cam assembly, an external handle coupled to a crank axle of the internal crank/cam assembly, the wedge head having at least one or a plurality of mating elements or prongs dimensioned to fit within a grid of apertures formed in the rosette, the wedge head having a bore through which the wedge portion wholly or partially extends to lock the wedge head, and hence, the upper horizontal mount member to the rosette and wholly or partially retract to unlock the wedge head, and hence, the upper horizontal mount member from the rosette.

The invention components can be fabricated from a variety of materials, including galvanized or powder coated steel, iron or other resilient material. The upper horizontal mount member 601, lower horizontal mount member 603 and vertical mount member 605 are preferably made of wall pipe, having, for example, an outer diameter of 1 to 3 inches, and 11 gauge. The attachment member 606 and reinforcing plate 607 can comprise a steel plate or plurality of steel plates as necessary dimensioned to provide sufficient load bearing capability.

The wedge head 602 preferably comprises a cast or machined head with two upper side faces and two lower side faces, each positioned at an acute angle with respect to each other, with a notch or gap therein-between to receive the rosette 201. A wedge key 608 inserted into a slot through the wedge head operates to lock the upper horizontal mount member 601 into a rosette 201 on a vertical scaffold member 103.

As further described, the invention comprises a vertical scaffold mount comprising a bracket with a lower portion and an upper portion; a rigid half coupler welded to a base of the lower portion of the bracket configured to bolt to a vertical scaffold member; and a wedge and wedge key arrangement coupled to the upper portion of the bracket, configured to be received at a rosette of a vertical scaffold member. A housing proximate the upper portion of the bracket, has a bolt pattern to receive bolts for coupling a swing stage motor to the bracket. A swing stage motor can then be coupled to the bracket. Swing stages are light duty platforms used, for example, as window washer platforms. The invention enables current components within the scaffold industry to be utilized with motorized equipment. The invention further comprises a heavy duty bracket that couples a swing stage motor to a wedge and ring rosette vertical scaffold member. The invention enables standard scaffold inventory to be utilized with motorized swing and suspended scaffold scenarios.

The embodiments shown and described above are only exemplary. Even though numerous characteristics and advantages of embodiments of the invention have been set forth in the foregoing description together with details of the invention, the disclosure is illustrative only and changes may be made within the principles of the invention to the full extent indicated by the broad general meaning of the terms used herein. Coupling includes, but is not limited to attaching, engaging, fixing, mounting, clamping, welding, bolting and components used for coupling include bolts and nuts, rivets, clevis, latches, clamps, welds, screws, rivets and the like. Further, a rosette having eight (8) radially arranged cut-outs is described herein for illustrative purposes and a rosette having more or less radially arranged cut-outs is considered to be within the scope of this invention. Also, the invention describes a rosette having a standard diameter of about seven (7) inches, however, any suitable diameter can be used. The rosette can include any suitable cut-out shape that is dimensioned to receive a non-integrated wedge or corresponding prong or set of prongs integrated with the wedge head. A vertical member used in combination with the invention can have any number of coaxially aligned rosettes attached thereto, the vertical spacing of such rosettes being any such distance as is suitable for the intended use.

I claim:

1. A mount, consisting essentially of:

a vertical mount member having an upper end and a lower end;

an upper horizontal mount member having a first end and a second end, a wedge head coupled to the first end of the upper horizontal mount member, the wedge head configured to be connected to a rosette of a vertical scaffold member;

the second end of the upper horizontal mount member positioned orthogonally to, and rigidly affixed proximate, the upper end of the vertical mount member wherein the second end of the upper horizontal mount member terminates at the vertical mount member, and a top portion of the upper end of the vertical mount member extends above the upper horizontal mount member;

a lower horizontal mount member substantially coplanar with the upper horizontal mount member, and having a first end and a second end;

a clamp mechanism coupled to the first end of the lower horizontal mount member, the clamp mechanism being coupled to the lower horizontal mount member;

the second end of the lower horizontal mount member positioned orthogonally to, and rigidly affixed proximate, the lower end of the vertical mount member, wherein the second end of the lower horizontal mount member terminates at the vertical mount member; and a planar attachment member rigidly coupled to both the top portion of the upper end of the vertical mount member and a top surface of the upper horizontal mount member adjacent the second end thereof, and extending substantially vertically along the plane defined by the upper and lower horizontal mount members, the attachment member further including at least one transverse through hole.

2. The mount of claim 1, wherein the wedge head is dimensioned to receive a wedge key for coupling the wedge head to a vertical scaffold member.

3. The mount of claim 1, in combination with a vertical scaffold member having at least one rosette coaxially aligned and rigidly fixed thereto.

4. The mount of claim 1, wherein the upper horizontal mount member and lower horizontal mount member are substantially parallel with respect to each other and lie substantially in the same plane.

5. The mount of claim 1, wherein the attachment member is comprised of one plate or a plurality of apposite plates having at least one transverse bore there-through.

6. The mount of claim 1, the attachment member further comprising a structure for receiving, either directly or indirectly, a cable for hoisting or lowering a scaffold to which the mount is mounted.

7. The mount of claim 6, in combination with a cable for hoisting or lowering a scaffold to which the mount is mounted.

8. The mount of claim 1, further comprising a reinforcing plate positioned in the plane of, and coupled to the upper horizontal mount member and vertical mount member so as to strengthen the attachment of the upper horizontal mount member to the vertical mount member.

9. The mount of claim 1, further comprising a reinforcing plate positioned in the plane of, and coupled to the lower horizontal mount member and vertical mount member so as to strengthen the attachment of the lower horizontal mount member to the vertical mount member.

10. The mount of claim 1, further comprising a reinforcing plate positioned in the plane of, and coupled to each of, the upper horizontal mount member, vertical mount member and lower horizontal mount member so as to strengthen the attachment of the upper horizontal mount member to the vertical mount member and the lower horizontal mount member to the vertical mount member.

11. A vertical scaffold mount comprising:

a bracket having a vertical mount member with a vertical mount upper end and a vertical mount lower end;

a lower horizontal member having a lower horizontal member first end and a lower horizontal member second end, the lower horizontal member second end rigidly attached orthogonally, and proximate to, the vertical mount lower end, wherein the lower horizontal member second end terminates at the attachment to the vertical mount member;

an upper horizontal member having an upper horizontal member first end and an upper horizontal member second end, the upper horizontal member second end rigidly attached orthogonally, and proximate to, the vertical mount upper end, wherein the upper horizontal member second end terminates at the attachment to the vertical mount member, and a top portion of the vertical mount upper end extends above the upper horizontal member;

wherein the lower horizontal member and upper horizontal member reside substantially in the same plane;

a planar attachment member rigidly coupled to both the top portion of the vertical mount upper end and a top surface of the upper horizontal member adjacent the second end thereof, and extending substantially vertically along the plane defined by the upper and lower horizontal members, the attachment member further including at least one transverse through hole;

a rigid half coupler welded to a base of the lower horizontal member first end configured to bolt to a vertical scaffold member; and a wedge and wedge key arrangement coupled to the upper horizontal member first end, configured to be connected to a rosette of a vertical scaffold member.

12. The vertical scaffold mount of claim 11, further comprising a swing stage motor.

* * * * *